United States Patent [19]

Scivoletto

[11] Patent Number: 4,955,145

[45] Date of Patent: Sep. 11, 1990

[54] HAIR DRYER ATTACHMENT

[75] Inventor: Joseph C. Scivoletto, Coral Springs, Fla.

[73] Assignee: Lisa Maria Scivoletto, Coral Springs, Fla.

[21] Appl. No.: 906,171

[22] Filed: Sep. 11, 1986

[51] Int. Cl.[5] ..... F26B 21/06

[52] U.S. Cl. ..... 132/271; 34/97; 34/101; 34/80

[58] Field of Search ..... 34/97, 101, 90; 132/9, 132/11, 112, 120; 219/367, 373, 369, 370

[56] References Cited

U.S. PATENT DOCUMENTS

| | | | |
|---|---|---|---|
| 1,951,269 | 3/1934 | Boeckx et al. | 98/40.18 |
| 3,145,691 | 8/1964 | Yates | 132/112 |
| 3,180,342 | 4/1965 | Dietsche | 132/120 |
| 3,730,190 | 5/1973 | Ford | 132/11 R |

*Primary Examiner*—Henry A. Bennet

[57] ABSTRACT

Disclosed herein is an attachment for a blow dryer which allows a person to dry hair from the roots towards the ends with a single hand. The attachment includes a means for connnection to the output side of the blow dryer and an air sheet forming means. Extending from the forming means is an air deflector which deflects the air sheet downward and extending from the remote end of the deflector is a plurality of picks each of which includes a hair lifter at the end thereof. The picks are offset from the surface of the deflector so that the deflected air sheet is deflected into the picks. The picks are spaced apart so as to act as an air diffuser to prevent too great an amount of air from being directed to the pick area. The attachment may be held onto the conventional blow dryer through the use of an elastic strap. In using the attachment it is moved into the area of the hair to be dried and thereafter lifted out. The lifters rise the hair to a generally vertical position from the scalp and the deflected air dries the lifted roots first and the remaining portion of the hair as the remainder of the attachment is moved outward. The attachment may be, thereafter, rotated to allow wavy or culed stylizing while drying, if desired.

20 Claims, 2 Drawing Sheets

HAIR DRYER ATTACHMENT

This invention relates to an attachment for a blow dryer and more particularly to such an attachment which lifts the hair and allows the blow dryer to which the attachment is attached to dry hair from the roots outward towards the ends.

The blow dryer has become a common household appliance and is used by both men and women for drying their hair. Typically, the blow dryer emits a stream of hot, dry air which is to be directed at the head of the person using the dryer. Different attachments can be connected to the output of most blow dryers to modify the air provided thereby. For example, it may be desired to accelerate the air as shown in U.S. Pat. No. 3,837,581 in the name of Orsoff or it may be desired to diffuse the air such as shown in U.S. Pat. No. 4,590,687 in the name of Caruso.

Wet hair will generally lay flat on the head and will bend very close to the roots of the hair due to the excess weight of the water. As the wet hair is dried by a blow dryer, the ends dry first and the roots last. This results in the hair laying in a generally flat position, similar to the position during the period of time when it was wet. In order to cause the hair to appear to have more body, professional hair stylists section the hair and dry the hair in the section first from the roots outward toward the ends. The hair stylists-accomplish this using a brush in one hand and the blow dryer in the other hand. The brush is used to stand the hair up and the air from the blow dryer is directed into the scalp at the roots. Thereafter, as the brush is pulled outward, the direction of the air is moved outward along the hair with the brush. By drying the hair from the roots outward, the dried hair can be made to extend outward from the scalp in either the direction in which it grows or any other direction desired by the stylist, rather than laying flat. This is referred to in the art of hairstyling as giving the hair more body for styling.

The problem with the afforementioned styling techniques is that two hands are required to accomplish the purpose of drying the hair from the roots outward, one hand for the dryer and the other hand for the hair brush or comb. This makes it difficult to do other required tasks, such as sectioning the hair to create an area to be styled, without putting down one of the dryer or the brush. It would be preferable to utilize a combination hair blower and comb mechanism in a single unit to free the other hand of the stylist for performing the other functions if necessary. Further, it would permit individuals to blow dry their hair utilizing the single combination dryer and comb mechanism, rather than having to rely on utilizing a brush in one hand and a dryer in the other hand. As a practical matter, it is very difficult to dry ones own hair in this manner since the person cannot see where to direct the air when the comb or brush lifts the hair. This is particularly true where an individual is attempting to dry the back of the hair, where they can not see, even with the aid of a mirror.

Comb mechanism attachments for blow dryers have been described in the prior art in, for example, U.S. Pat. No. 3,145,691 in the name of Yates, U.S. Pat. No. 2,576,368 in the name of Steiner, U.S. Pat. No. 3,730,190 in the name of Ford and U.S. Pat. No. 2,478,559 in the name of Bergeron. Other patents relating to attachments of hair dryers include U.S. Pat. No. 3,857,016 in the name of Meyer et al, U.S. Pat. No. 4,471,791 in the name of Deroche and U.S. Pat. No. 1,951,269 in the name of Boeckx et al. Further, the inventor hereof has patended certain rotating comb and blow dryer assemblies described in U.S. Pat. Nos. 3,894,547, 3,863,652 and 3,894,549.

The problem with each of the aforementioned patents is that none of them are fully able to lift up the hair and dry the hair from the roots towards the ends in order to achieve a full bodied hair style appearance. Another problem with the subject matter of the aformentioned patents is that the output from the blower is generally applied directly at the scalp. This can cause either the scalp to feel hot in the area being dried or can cause too much air to be focused at one point and not allowing the proper drying effect to occur. This problem has been overcome in other applications without comb members attached to the dryer by using diffusers.

In accordance with one aspect of this invention, there is provided an attachment for a blow dryer comprising a plurality of picks, each including hair lifting means and means for directing air emitted by the blow dryer towards the lifting means. Additionally the attachment includes means for attaching the attachment to the blow dryer.

One preferred embodiment of the subject invention is hereafter described with specific reference being made to the following Figures in which.

Figure 1:
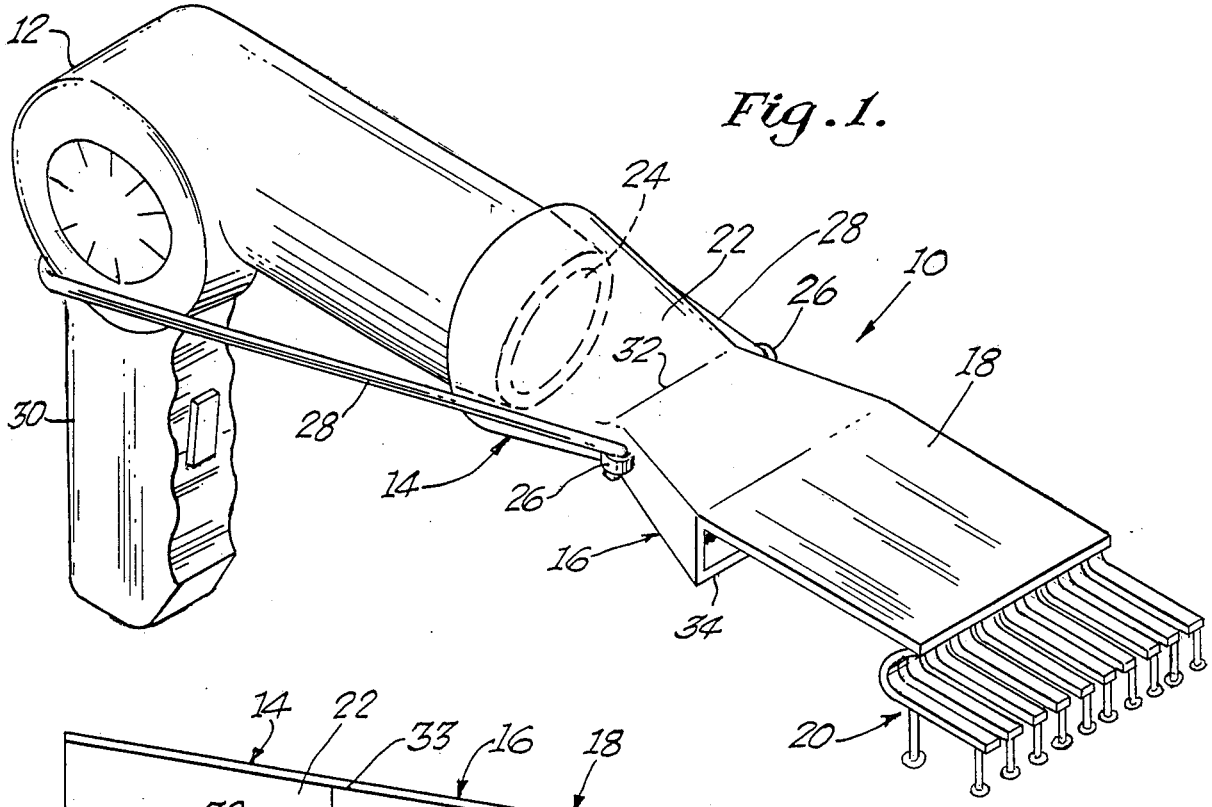
FIG. 1 is a prospective view of the attachment of the subject invention coupled to a conventional blow dryer.

Referring now to FIG. 1, a blow dryer attachment 10 adapted for being attached to a blow dryer 12 is shown. Blow dryer 12 may be any conventional blow dryer which projects a column of air from its air exit. Attachment 10 includes four major portions which are referred to as the attachment portion 14, the air forming portion 16, the air deflector portion 18 and the hair lifter portion 20.

The attachment portion 14 includes a hollow cone shaped member 22 adapted to fit over the output 24 of hair dryer 12. Due to the cone shape, attachment portion may be used with different types of hair dryers even though the size of the output may vary. In addition, attachment portion 14 includes a pair of strap hooks 26 to which an elastic strap 28 may be attached. Strap 28 should be adjustably sized to fit snugly along the back 30 of dryer 12 so as to hold the entire blow dryer attachment 10 firmly against dryer 12. The inside surface of cone member 22 should be smooth so as to prevent any back flow of the air emitted from the output 24 of dryer 12 back into dryer 12. Such a back flow of air could cause dryer 12 to overheat thereby burning out the motor and heater elements thereof.

The attachment portion 14 just described is a universal attachment which can be used with many different size blow dryers with circular shaped outputs. The air from the dryer output is provided from the dryer output 24 to the small end opening 32 of cone 22. Alternatively, attachment portion 14 could be replaced by a specific attachment adapted for a single dryer which could be snap locked or rotated in place. With such a device, care must be taken to insure that the entire attachment assembly 10 does not become uncoupled from the blow dryer during the use of attachment 10. As will be explained hereafter, significant forces will exist pulling attachment 10 away from dryer 12 or that the coupling mechanism must be secure. As long as elastic strap 28 is in place these forces will not disengage the attachment 10 from dryer 12 as seen in FIG. 1.

Figure 2:
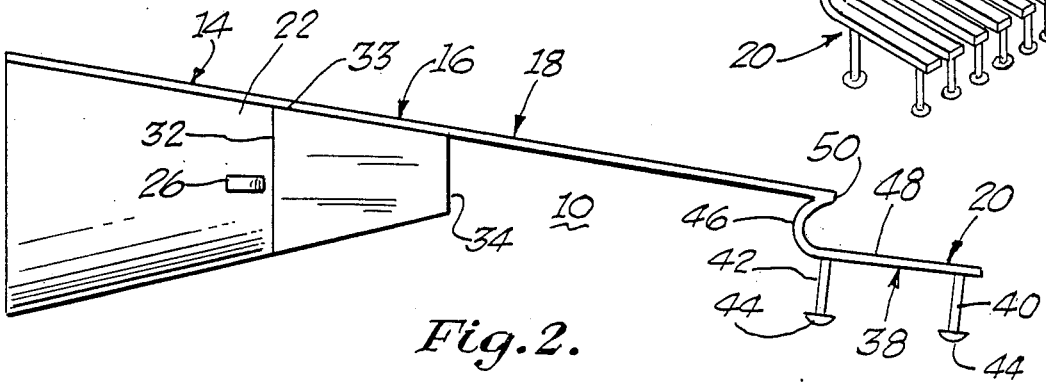
FIG. 2 is a plan side view of the attachment of the subject invention.
Figure 3:
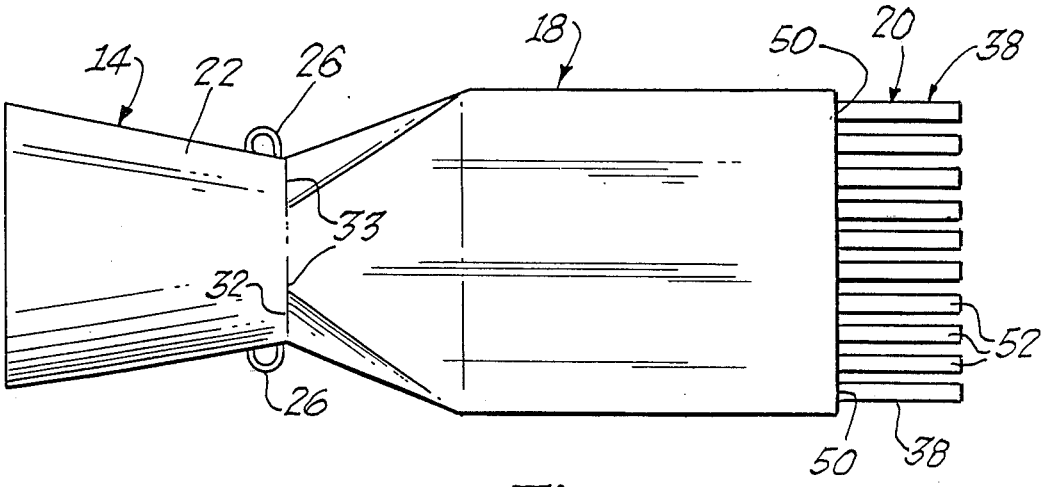
FIG 3 is a plan top view of the attachment of the subject invention.
Figure 4:
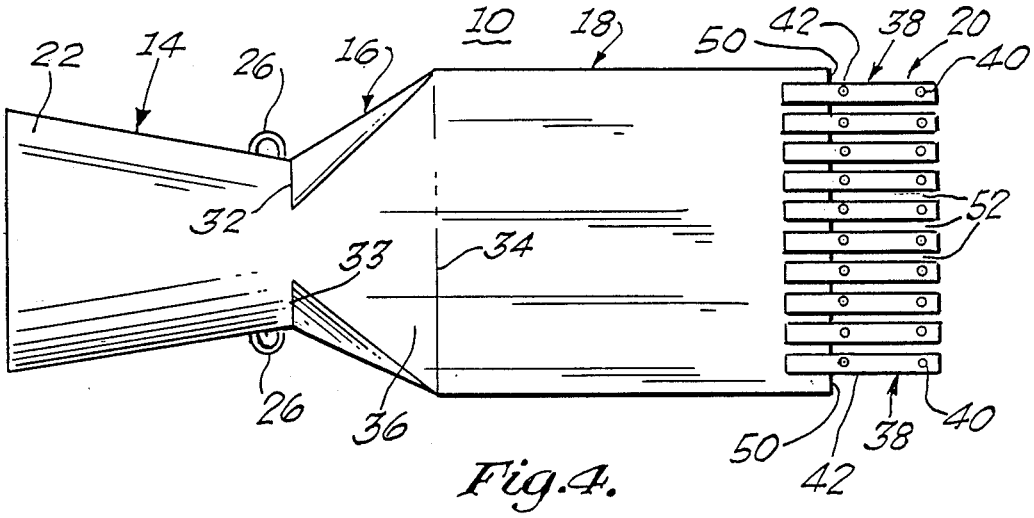
FIG. 4 is a plan bottom view of the attachment of the subject invention.

Referring now to FIGS. 2, 3 and 4 the air forming portion 16 and the air deflector portion 18 of attachment 10 will now be described. The purpose of air forming portion 16 is to reshape the circular column of air exiting from end 32 of cone member 22 into a rectangular sheet of air. The end 33 of air forming portion 16 extending from the small end 32 of cone 22, is circular in shape and of the same size as the end 32 of cone 22. The other end 34 of air forming portion 14 is rectangular in shape having the width of approximately two and one half inches and the depth of approximately one half of an inch. Connecting ends 33 and 34 is the body 36 of air forming portion 16, which is any conventional shape for converting a circular input to a rectangular output. Generally on the top and bottom of body 36 are flat converging triangles portion and the sides of body 36 are curved so as to connect the top and bottom triangles.

The air emitted from dryer 12 thus enters attachment 10 through the interior of cone 22 and is reshaped in the air forming portion 16 to exit from end 34 as a sheet of air which has a width and depth generally defined by the opening of end 34. It should be noted that the top and bottom of body portion 36 slopes inward on the same path as the cone 22, as seen in FIG. 2, to form the depth of opening 34. The curved sides, on the other hand, extend outward from ends 32 and 33 to form the width of body 34 as seen in FIGS. 3 and 4.

The air deflector portion 18 consists of a flat, planar surface of approximately two inches in width and three inches in length extending outward from the top of opening 34. The top surface of deflector 18 continues on the same sloping plane as that portion of body 36 connecting the small end 32 of cone 22 with the top of opening 34, as best seen in FIG. 2. Thus, deflector 18 is positioned at an angle with respect to the sheet of air which is emitted from opening 34. By properly sizing air deflector 18 and selecting the sloping angle, all, or a substantial portion of, the air emitted form opening 34 intersects the bottom of deflector 18 and is deflected downward thereby. The deflection is designed such that the air is deflected to intersect the hair lifting portion 20.

Figure 5:
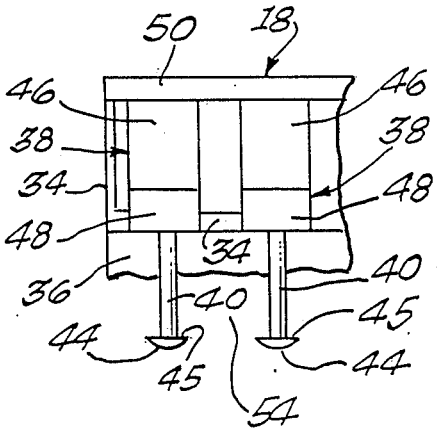
FIG. 5 is an enlarged view of the picks utilized in the attachment of the subject invention.

Referring now, additionally, to FIG. 5, along with FIGS. 2, 3 and 4, the hair lifting picks portion 20 will now be described. The hair lifting portion 20 includes a pick holder 38, from which extends a front pick 40 and a rear pick 42. Each of the picks 40 and 42 include a lifter mechanism 44 at the bottom thereof. The pick holder 38 includes a curved extension 46, best seen in FIG. 2, extending from the far end of deflector 18. Curved extension 46 curves downward from the under side of deflector 18 into a straight extension 48. The picks 40 and 42 extend downward from straight extension 48. Generally, straight extension 48 is parallel to deflector 18.

The pick holder 38 and pick 40 and 42, as just described, form a pick assembly 50. A plurality, such as eleven pick assemblies 50 are each positioned along the front edge 50 of deflector 18. Each of the pick holder assemblies 38 are spaced apart from one another so that a gap 52 exists between each of the pick assemblies 38. The forward pick 40 and rear pick 42 are smaller in size than each of the curved extension 46 and straight extension 48 and, thus, a greater gap 54 exists between each of the adjacent picks 40 or 42 extending from the pick assemblies 38. The purpose of the gaps 52 and 54 are to act as an air diffuser for the deflected sheet of air emitted from end 34 of air forming portion 16.

Figure 6:
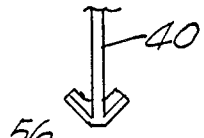
FIG. 6 is an alternate type of pick which could be used with the attachment of the subject invention.

The hair lifter mechanism 44 may simply be a hemisphere or sphere sector, attached to the bottom of each of the picks 40 and 42 as seen in FIG. 5 or it may include a Vee shaped extension 56 extending from the bottom of each of the picks 40 or 42 as seen in FIG. 6. If the hemisphere or sphere sector is used, the diameter of the sphere must be greater than the diameter of the pick 40 or 42 so that the hair can be caught on the portion 45 and lifted as the entire assembly 10 is moved out of the hair. The purpose of the lifters 44 or 56 is to lift the hair to a generally vertical position outward from the scalp so that the air deflected by deflector 18 toward the picks 40 and 42 will dry the bottom of the hair first and, then as the attachment 10 is moved outward from the scalp, the remaining portion of the hair is dried. Attachment 10 can be pulled upward out of the scalp either in a straight, generally vertical line from the scalp, or it can be rotated as it is moved to allow the hair remote from the root area to be dried in a curled or waved manner. Even by rotating attachment 10, the roots are dried first so that they extend outward rather than being bent flat against the scalp. This assures that whatever hairdo is fashioned, that hairdo will contain a full bodied look. Further, the entire drying procedure is accomplished with one hand.

When using attachment 10, the stylist first sections the hair to separate a section of hair to be styled. Then the stylist decides the direction toward which the hair of that section is to extend and slides the picks portion 20 of attachment 10 into the section of hair to be styled in the desired direction so that the bottom of the lifters 44 rest on or near the scalp. At this point in time, the hot air from dryer 12 is directed through the pick holders 38, and diffused thereby, towards the hair roots. Next, the stylist lifts attachment 10 backward and outward opposite to the desired direction of hair extension. The hot air blown from the dryer 12 then directs the hair in the desired direction.

If the stylist desires to create volume on curly hair, the stylist would only lift attachment 10 slowly until the lifter 44 are at the midway point between the roots and the ends of the hair. Then attachment 10 would be moved at a quicker rate out of the hair. On the other hand, to create volume on straight hair, the stylist would lift attachment 10 completely out of the hair at a slow rate. To create a wavy hair style, the stylist would leave attachment 10 positioned near the roots for five to ten seconds until the roots were dry and then rotate attachment 10 out of the hair to only partially dry the remainder of the hair.

Figure 8:
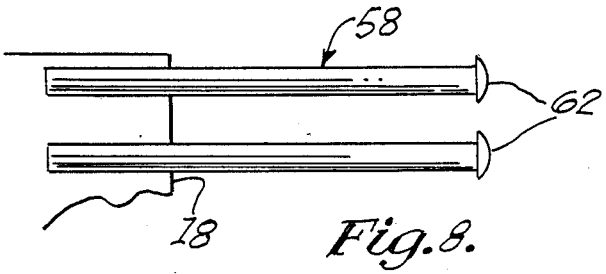
FIG. 8 shows an enlargement of the picks of the alternate embodiment shown in FIG. 7.
Figure 7:
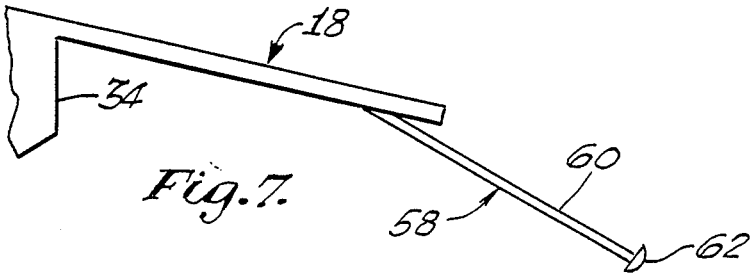
FIG. 7 shows an alternate embodiment of the subject invention.

Referring now to FIGS. 7 and 8, an alternate embodiment of the subject invention is shown. In FIGS. 7 and 8, like numerical components are given like numerical designations and will not be described again in detail, except as necessary. The difference between the embodiment of FIGS. 7 and 8 and the enbodiment described above with respect to FIGS. 1–6 is in the hair lifting portion 58. In the FIGS. 7 and 8 embodiment, the picks 60 extend generally in a straight line from deflector 18 and the lifter 62 is positioned at the end of each of the picks 60. In portion 58, there is no vertical or horizontal portions, as with respect to the FIG. 1–6 embodiment. Alternatively, picks 58 could have been shaped so that the end of the pick is either horizontal, vertical or in any direction desired.

Attachment 10 may be fabricated by conventional injection molding techniques as a single piece of injection molded plastic.

What is claimed is:

1. An attachment for a blow dryer comprising:

a plurality of picks, each extending from said attachment and having an end remote from said attachment;

hair catching means having one end thereof attached to said remote end of each of said picks, said hair catching means having a hair catching surface facing away from the other end thereof;

means for directing air emitted by said blow dryer towards said hair catching means; and means for attaching said attachment to said blow dryer.

2. The invention according to claim 1 wherein each of said picks include of first member extending from said means for directing and a second member, extending generally vertically from said first member, said second member having said hair lifting means attached thereto at the end remote from said first member.

3. The invention according to claim 2 wherein each of said picks are spaced apart from adjacent picks.

4. The invention according to clim 3:

wherein said means for attching includes air forming means for forming the air from said dryer into a sheet of air; and wherein said means for directing is a flat surface extending from said means for attaching into said formed sheet of air.

5. The invention according to claim 4 wherein said plurality of picks extend from the edge of said flat surface remote from said means for attaching.

6. The invention according to claim 1 wherein each of said picks are spaced apart from adjacent picks.

7. The invention accordingto claim 1:

wherein said means for attaching includes air forming means for forming the air from said dryer into a sheet of air; and wherein said means for directing is a flat surface extending from said means for attaching into said formed sheet of air.

8. The invention according to claim 7 wherein said plurality of picks extend from the edge of said flat surface remote from said means for attaching.

9. The invention according to claim 8 wherein each of said picks are spaced apart from adjacent picks.

10. The invention according to claim 7 wherein each of said picks are spaced apart from adjacent picks.

11. An attachment for a blow dryer comprising:

a base assembly, including means for being attached to the air outlet of said dryer;

an air deflector extending from said base assembly to deflect at least some of the air emitted from said outlet; and a plurality of spaced apart picks, each extending from said deflector and having an end remote from said deflector;

a hair catcher having one end thereof attached to said remote end of each pick, said hair catcher having a catching surface facing away from the other end thereof, each pick and attached hair catcher extending into the path of said deflected air.

12. The invention according to claim 11 wherein said picks include spaced apart means coupling said picks to said deflector.

13. The invention according to claim 11 wherein said base assembly and deflector position said picks at a distance from said dryer.

14. The invention according to claim 11 wherein said base assembly includes means for forming the air emitted from said dryer into a sheet of air.

15. The invention according to claim 11 wherein said picks are attached to said deflector and the spacing between each pick is selected to act as a diffuser.

16. An attachment for a blow dryer for drying hair from the roots towards the ends said attachment being adapted to receive heated air from the air exit of said dryer, said attachment comprising:

means for attaching said attachment to said dryer and for forming the air provided by said dryer into a sheet;

deflector means extending from said means for attaching and forming at an angle into said sheet for deflecting said sheet, said means for attaching and forming and said deflector means being sized to maintain any backflow of air into said dryer within the acceptable limits of said dryer; and a plurality of hair picks extending from said deflector means and positioned to intersect said deflected sheet;

said deflector means including an air diffuser attached at the end, remote from said means for forming and attaching, of said deflector means; and said plurality of hair picks extending from said diffuser means.

17. The invention according to claim 16 wherein said hair picks each include a hair lifter attached to the end thereof remote from said diffuser, each lifter being shaped to lift hair as said attachment is moved away from the roots of the hair.

18. The invention according to claim 17 wherein said means for attaching and forming includes:

means for attaching said attachment to the outlet of said dryer; and means, remote from said means for attaching, for forming the air provided by said dryer into a sheet of air;

said deflector means being attached to said means for forming and extending therefrom in a direction away from said means for attaching.

19. The invention according to claim 18 wherein said deflector extends entirely into said formed sheet of air.

20. The invention according to claim 16 wherein said means for attaching and forming includes:

means for attaching said attachment to the outlet of said dryer; and means, remote from said means for attaching, for forming the air provided by said dryer into a sheet of air;

said deflector means being attached to said means for forming and extending therefrom in a direction away from said means for attaching.

* * * * *